US005852889A

United States Patent [19]

Rinaldi

[11] Patent Number: 5,852,889

[45] Date of Patent: Dec. 29, 1998

[54] GREETING CARD WITH SELF-INFLATING BALLOON

[76] Inventor: Robert Rinaldi, 2116 Kingston Pl., Bakersfield, Calif. 93306

[21] Appl. No.: 645,667

[22] Filed: May 14, 1996

Related U.S. Application Data

[63] Continuation-in-part of Ser. No. 298,850, Aug. 31, 1994, abandoned.

[51] Int. Cl.[6] ..... G09F 1/00

[52] U.S. Cl. ..... 40/124.06; 40/124.11; 446/220; 472/134

[58] Field of Search ..... 40/124.01, 124.06, 40/124.11, 124.191, 412, 439; 472/134; 446/220

[56] References Cited

U.S. PATENT DOCUMENTS

| | | | |
|---|---|---|---|
| 4,484,768 | 11/1984 | Norfleet . | |
| 4,787,160 | 11/1988 | Balsamo . | |
| 4,813,902 | 3/1989 | Messer . | |
| 4,857,029 | 8/1989 | Dierick et al. | 446/220 |
| 4,870,764 | 10/1989 | Boone . | |
| 4,883,692 | 11/1989 | Spector . | |
| 4,898,561 | 2/1990 | Nottingham et al. | 446/220 |
| 4,903,958 | 2/1990 | DiCarlo et al. | 446/220 X |
| 4,920,674 | 5/1990 | Shaeffer | 446/220 X |
| 4,951,404 | 8/1990 | Lithwick . | |
| 5,009,624 | 4/1991 | Estam-Goggin . | |
| 5,010,669 | 4/1991 | Moran . | |
| 5,055,084 | 10/1991 | Jokic . | |
| 5,083,771 | 1/1992 | Tyner | 446/220 X |
| 5,083,961 | 1/1992 | Ishiwa . | |
| 5,199,745 | 4/1993 | Balsamo . | |
| 5,234,726 | 8/1993 | Dahan | 446/220 X |
| 5,263,890 | 11/1993 | Dent, IV . | |
| 5,275,285 | 1/1994 | Clegg | 206/449 |
| 5,399,122 | 3/1995 | Slater | 472/134 X |

*Primary Examiner*—Kenneth J. Dorner
*Assistant Examiner*—Andrea Chop
*Attorney, Agent, or Firm*—John J. Posta, Jr.

[57] ABSTRACT

A greeting card is disclosed which has a self-inflating balloon contained therein, which balloon inflates either upon opening the greeting card, upon removing the greeting card from an envelope, or upon manual activation by the individual receiving the greeting card. A gas generator is provided with two reactants which are separated by a physical barrier until the device is activated, at which time the reactants mix to generate gas used to inflate the balloon. In the preferred embodiment, the physical barrier is a zipper-like fastener element which is pulled apart by a triggering mechanism to activate the gas generator to inflate the balloon.

36 Claims, 8 Drawing Sheets

FIG. 15
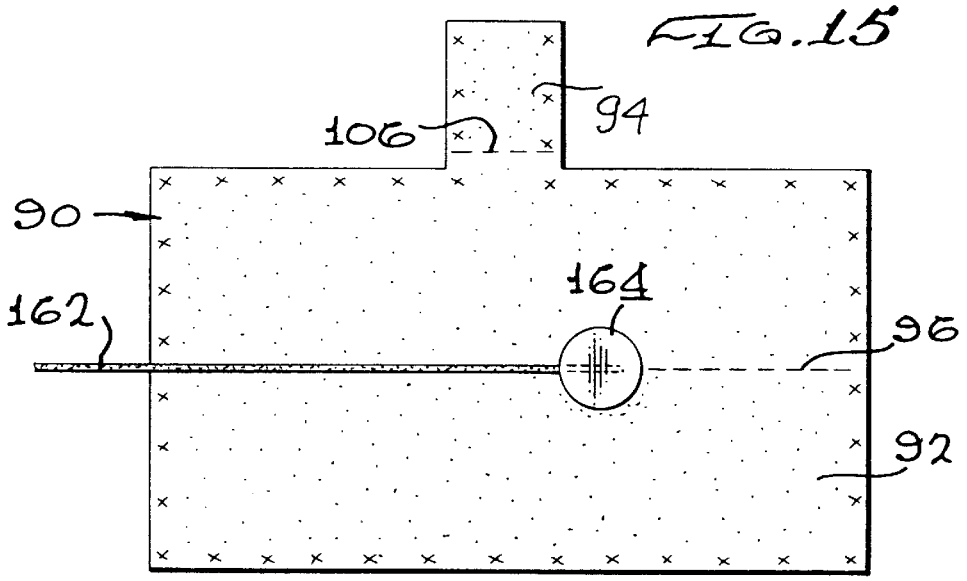
FIG. 17
FIG. 16
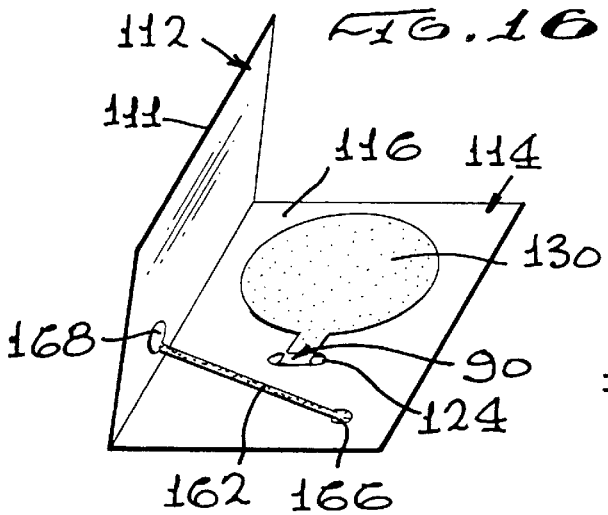
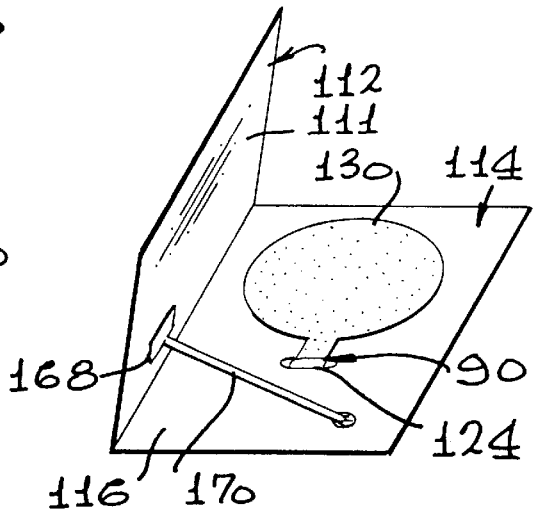
FIG. 18
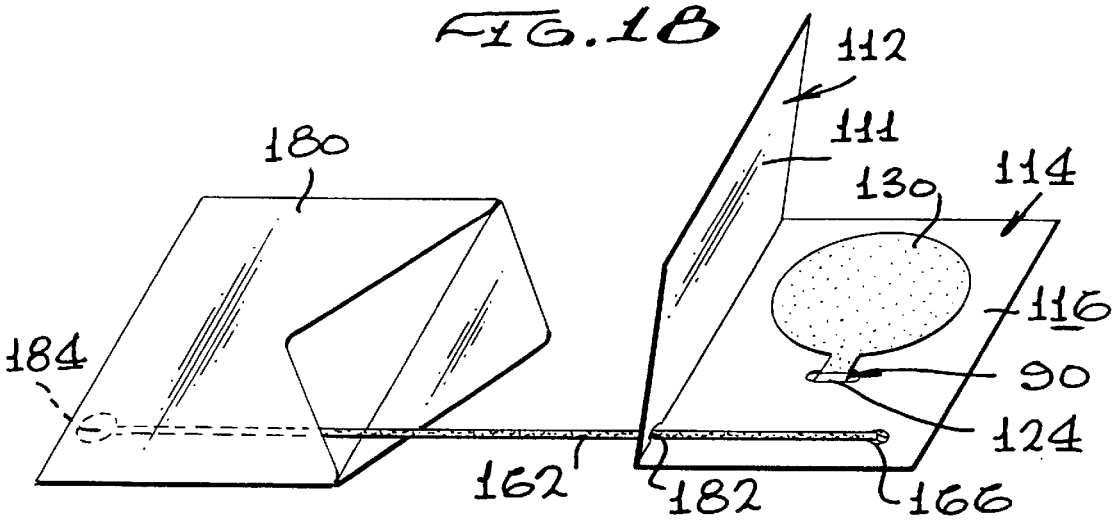

FIG. 22
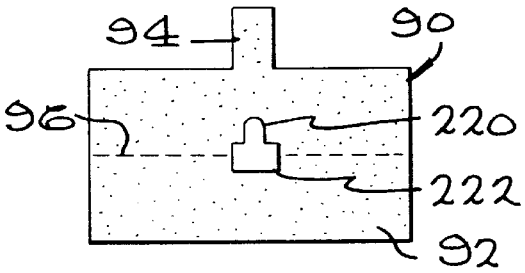
FIG. 23
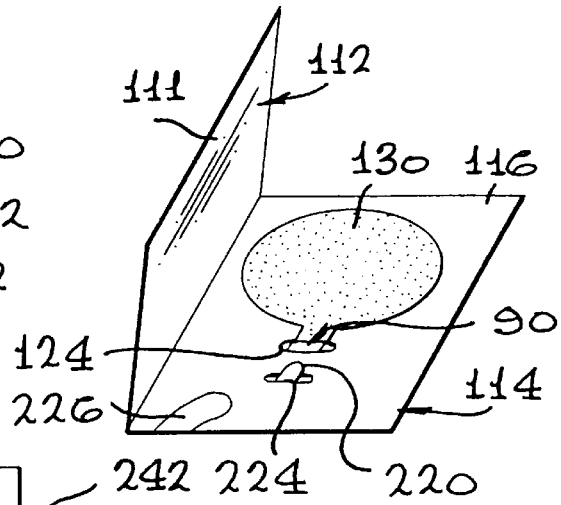
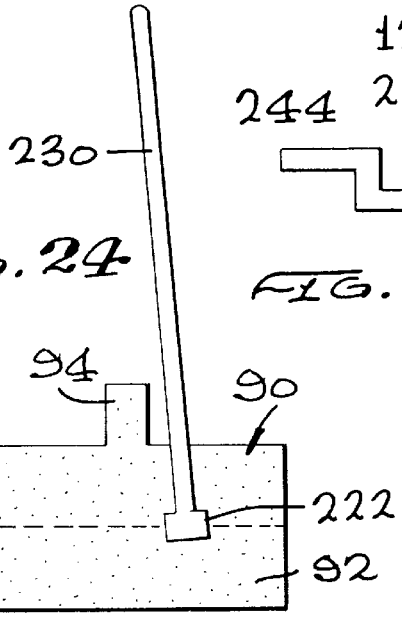
FIG. 24
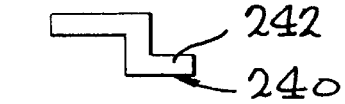
FIG. 26
FIG. 25
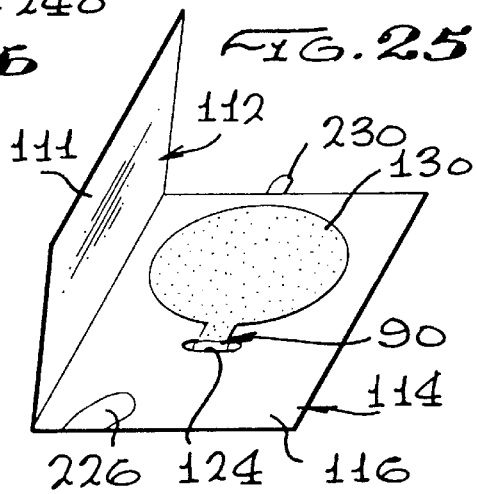
FIG. 27
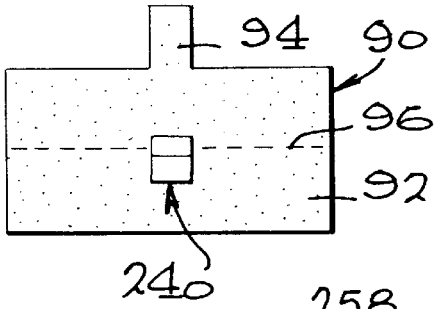
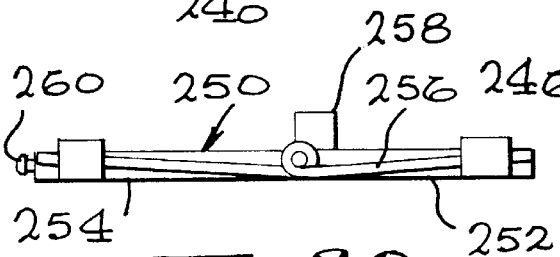
FIG. 29
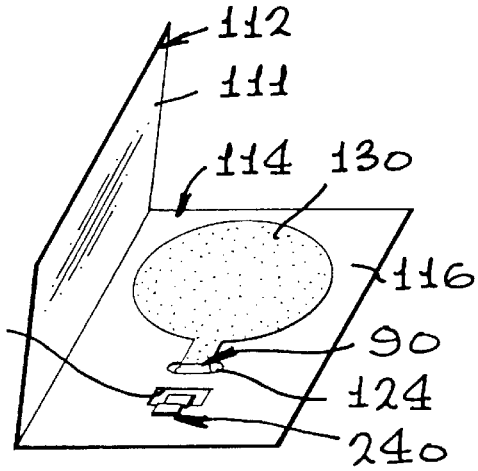
FIG. 28

GREETING CARD WITH SELF-INFLATING BALLOON

IDENTIFICATION OF RELATED APPLICATION

This application is a continuation-in-part of U.S. patent application Ser. No. 08/298,850, filed on Aug. 31, 1994, now abandoned, and entitled "Balloon Carrying Greeting Card."

BACKGROUND OF THE INVENTION

FIELD OF THE INVENTION

The present invention relates generally to a greeting card, and more particularly to a greeting card having a self-inflating balloon contained therein which balloon inflates either upon opening the greeting card, upon removing the greeting card from an envelope, or upon manual activation by the individual receiving the greeting card.

Greeting cards are available for virtually any holiday or special occasion, from an ever-increasing number of annual holidays, to a wide variety of special days for a particular individual, to cards which may be sent for no particular occasion. Greeting cards range from simple, inexpensive printed cards, to more elaborate (and expensive) cards, to novelty cards which play music, light up, or contain moving mechanisms. While receiving a card of any kind is a positive experience, receiving an elaborate or novelty card is an unusual or even extraordinary event in the lives of most people.

By way of example, several novelty cards known in the art are disclosed in U.S. Pat. No. 4,484,768, to Norfleet, in U.S. Pat. No. 4,491,404, to Lithwick, in U.S. Pat. No. 5,055,084, to Jokic, in U.S. Pat. No. 5,010,669, to Moran, and in U.S. Pat. No. 5,199,745, to Balsomo. Norfleet discloses a card which, when opened, ruptures a container to produce an odor. Lithwick teaches a card having a transparent window in its outer panel through which the inner panel is visible. Jokic provides a box-like card having a spring-loaded message panel which pops out when the card is opened. Moran teaches a post card with a pop-out figure contained therein. Finally, Balsomo discloses a card which, when opened, spills confetti therefrom.

As is evident from the previous discussion, a considerable amount of thought has gone into expanding the already wide variety of greeting cards available, yet there are yet unfulfilled areas of expansion which other types of gifts typify. For example, florists have long since expanded into inflatable novelty balloons with a variety of greetings and sentiments imprinted thereon. Such balloons, which are typically made of thin, metallized plastic film, are available with a wide variety of sentiments thereon, and command a price above the price of most greeting cards.

Such balloons make excellent gifts, and often produce in the recipient of the balloon an impression similar to that generated upon the receipt of a novelty greeting card. The problem with such balloons is that when filled, they are bulky and unsuitable for mailing. While empty balloons can certainly contain a message, the impact upon an individual receiving such a balloon is considerably less when the balloon is received in an uninflated state.

Accordingly, there existed in the greeting card art a need for a new greeting card concept which provided the recipient with an impact similar to the receipt of an inflated balloon. U.S. patent application Ser. No. 08/298,850, filed on Aug. 31, 1994, which application is commonly owned with the present patent application, and which application is the parent application of the present patent application, is the first invention to provide a greeting card with such an impact. It discloses a greeting card which contains therein a balloon which is inflated when the card is opened. U.S. patent application Ser. No. 08/298,850 is hereby incorporate herein by reference.

The above incorporated by reference application is the only known reference which contains an inflatable device in a greeting card. In other arts, particularly in the toy art, self-inflating devices are known. Four such references in the toy art are U.S. Pat. No. 2,516,552, to Clark et al., U.S. Pat. No. 4,781,645, to Kato, U.S. Pat. No. 4,758,198, to Ishiwa, and U.S. Pat. No. 5,083,961, also to Ishiwa. The Clark et al. reference is an inflatable toy. The Kato reference is a self-inflating bag which, when activated, inflates with a series of bangs. The Ishiwa '198 reference teaches an inflatable toy, while the Ishiwa '961 reference discloses both a manually inflatable toy and such a toy mounted in a base member from which it pops up. The Ishiwa '961 reference optionally has a swing-up background member.

The Clark et al. reference uses a pellet which contains a gas-releasing medium. The other three toy references disclosed immediately above all operate on a similar principal. All three use two reactants which are physically separated by a barrier which is breached when pressure is manually placed on the proper location in the toy. These references are all toys, and even the Ishiwa '961 reference uses the swing-up panel only as a background. Pressure must be manually placed upon the inflatable toy portion after the panel is opened and swung out of the way.

Thus, only the above-incorporated by reference parent application to the present patent application teaches a greeting card containing a balloon therein which inflates when the card is opened. While the parent application is significant, it only disclosed a single embodiment. The present application contains a number of improvements, enhancements, and additional embodiments to the invention of the parent application.

It is accordingly the primary objective of the present invention to provide an improved greeting card which contains a balloon therein, with the balloon being automatically inflated when the card is opened by the recipient of the card. It is a related objective of the balloon greeting card of the present invention that the mechanism for inflating the balloon when the card is opened be of simple and fool-proof construction. It is a further objective of the balloon greeting card of the present invention that the triggering mechanism not be set when the card is purchased, but rather that the individual sending the card be allowed to set the mechanism after writing a personal message inside the card. Further, it is an objective that the triggering mechanism be easy to set by the individual sending the card.

It is an additional objective of the balloon greeting card of the present invention that the balloon may bear a message which is displayed when the balloon is inflated when the recipient opens the card. It is a further objective of the balloon greeting card of the present invention that it resemble an ordinary greeting card to the greatest extent possible, and that it not be unduly thick or bulky. It is yet another objective of the balloon greeting card of the present invention that it be safe for use by children, which thereby requires that the self-inflating mechanism not use dangerous or unsafe materials. It is yet a further objective that the materials used for inflation of the balloon be environmentally friendly.

The balloon greeting card of the present invention must also be of construction which is dependable in operation and which has the capacity for extended storage prior to use, and it should not require that special storage conditions be provided by the seller during its shelf life. In order to maximize the market appeal of the balloon greeting card of the present invention, it should also be of inexpensive construction to thereby afford it the broadest possible market. Finally, it is also an objective that all of the aforesaid advantages and objectives of the balloon greeting card of the present invention be achieved without incurring any substantial relative disadvantage.

SUMMARY OF THE INVENTION

The disadvantages and limitations of the background art discussed above are overcome by the present invention. With this invention, a greeting card is provided with a self-inflating balloon contained therein. In the preferred embodiment, the balloon inflates upon opening the greeting card, while alternate embodiments are provided for initiating the inflation of the balloon upon removing the greeting card from an envelope, or upon manual activation by the individual receiving the greeting card. The inflation mechanism is essentially identical in all of the embodiments, with the triggering mechanism varying from embodiment to embodiment.

In the preferred embodiment, the inflation mechanism is a gas generator which consists of a flat, closed plastic film bag which has a neck extending therefrom. The neck communicates with the interior of the plastic film bag, and is sealingly connected to the neck of a balloon so as to be in fluid communication with the interior of the balloon. The balloon may be made from a thin plastic film, which may be metallized if desired.

The plastic film bag is separated into two halves by a ribbed zipper-like fastener element (similar to a Ziplock® fastener, Ziplock® being a registered trademark of Dow Chemical). The zipper-like fastener element has two mating halves which are located on facing sides of the interior of the plastic film bag. When the zipper-like fastener element is closed, only one half of the interior of the plastic film bag is in fluid communication with the neck of the plastic film bag, with the other half of the interior of the plastic film bag being isolated from the neck of the plastic film bag by the zipper-like fastener element.

Two reactants are respectively placed inside the two halves of the plastic film bag, with the zipper-like fastener element being closed to separate them. In the preferred embodiment, the reactants are an acidic material and an alkaline material, which, when mixed, will generate carbon dioxide gas. By causing the zipper-like fastener element to open, the two reactants will mix, generating gas and inflating the balloon. The zipper-like fastener will be opened and the gas generator thereby activated when a triggering mechanism is actuated.

The greeting card of the present invention consists of two flat panels which are hingedly interconnected at one side thereof, as is conventional with greeting cards. When the card is closed, the first panel overlays the second panel. The second panel preferably has front and back plies, with the gas generator being located between the plies with the neck of the plastic film bag extending through an aperture in the front ply. The balloon, which is connected to the neck of the plastic film bag, thus is located between the two panels when the card is closed.

The actuation mechanism of the preferred embodiment is intended to activate the gas generator when the greeting card is opened. In a first embodiment of this type, a biasing mechanism is provided between the two plies of the second panel of the card, with a triggering member being located on top of the second panel. By securing the triggering member to the first panel, when the card is next opened the triggering member will be removed from the biasing mechanism and the gas generator will be activated. Alternately, by exposing part of the plastic film bag through a window in the top ply of the second panel and selectively coupling the exposed portion of the plastic film bag to the first panel, the gas generator may be activated when the card is opened.

A second type of triggering mechanism allows the recipient to activate the gas generator after opening the greeting card. This may be accomplished by providing a pull tab which is coupled to the plastic film bag adjacent the zipper-like fastener element. The pull tab may be located at various positions on the card, such as at the top or near the bottom of the card.

A third type of triggering mechanism activates the gas generator when the greeting card is removed from an envelope in which it is delivered. This may be accomplished using a string extending from the plastic film bag at a location adjacent the zipper-like fastener element to the envelope. Thus, as the card is removed from the envelope, the string is pulled to activate the gas generator.

One additional alternate embodiment is disclosed herein. In this embodiment, the gas generator and the balloon are combined into a single unit. Thus, the zipper-like fastener element is actually located inside the balloon, as are both of the reactants. The balloon may be fastened to the second panel, with the top of the balloon being selectively coupled to the first panel to cause the gas generator to be activated when the card is opened.

It may therefore be seen that the present invention teaches an improved greeting card which contains a balloon therein, which balloon is automatically inflated when the card is opened by the recipient of the card. The mechanism for inflating the balloon when the card is opened is of simple and fool-proof construction. The triggering mechanism is not set when the card is purchased, but rather the individual sending the card is allowed to set the mechanism after writing a personal message inside the card. Further, the triggering mechanism is easy to set by the individual sending the card.

If desired, the balloon contained in the balloon greeting card of the present invention may bear a message which is displayed when the balloon is inflated following the recipient opening the card. In appearance, the balloon greeting card of the present invention resembles an ordinary greeting card, and is not unduly thick or bulky. The balloon greeting card of the present invention is safe for use by children, since the self-inflating mechanism does not use dangerous or unsafe materials. Further, the materials used for inflation of the balloon are also environmentally friendly.

The balloon greeting card of the present invention is of a construction which is dependable in operation and which has the capacity for extended storage prior to use, and the card does not require special storage conditions during its shelf life. The balloon greeting card of the present invention is of inexpensive construction to maximize its market appeal and to afford it the broadest possible market. Finally, all of the aforesaid advantages and objectives of the balloon greeting card of the present invention are achieved without incurring any substantial relative disadvantage.

DESCRIPTION OF THE DRAWINGS

These and other advantages of the present invention are best understood with reference to the drawings, in which:

FIG. 15 is a top plan view of a gas generator, showing a flat plastic film bag sealed around the edges thereof (the sealed edges being illustrated by a series of X's), with a neck extending from a side of the plastic film bag at the center of one side thereof, the neck having an internal septum at a location illustrated by a dotted line, also showing the location of a zipper-like fastener element located inside the plastic film bag with a dotted line, and also showing a string having one end attached to the plastic film bag with a thin adhesive disc;

FIG. 16 is a perspective view of a second alternate embodiment greeting card having two panels, with the gas generator illustrated in FIG. 15 located inside the second panel with the string extending through an aperture in the top ply of the second panel to the back of the first panel, where it is secured with a thin adhesive disc;

FIG. 17 is a perspective view of a third alternate embodiment greeting card having two panels, with a gas generator similar to the one illustrated in FIG. 15 located inside the second panel, with a pull tab used instead of the string illustrated in FIG. 16, the pull tab extending through an aperture in the top ply of the second panel to the back of the first panel, where it is secured with a thin adhesive disc;

FIG. 18 is a perspective view of a fourth alternate embodiment greeting card having two panels, with the gas generator illustrated in FIG. 15 located inside the second panel with the string extending through an aperture in the top ply of the second panel and through an aperture located at the intersection of the first and second panels, also showing an envelope in which the greeting card may be placed, the string extending into the interior of the envelope, where it is secured with a thin adhesive disc shown in dotted lines;

FIG. 22 is a top plan view of a gas generator, showing a flat plastic film bag sealed around the edges thereof, with a neck extending from a side of the plastic film bag at the center of one side thereof, also showing the location of a zipper-like fastener element located inside the plastic film bag with a dotted line, and also showing a short tab secured by a thin adhesive disc to the plastic film bag;

FIG. 23 is a perspective view of a sixth alternate embodiment greeting card having two panels, with the gas generator illustrated in FIG. 22 located inside the second panel, with the pull tab extending through an aperture in the top ply of the second panel;

FIG. 24 is a top plan view of a gas generator, showing a flat plastic film bag sealed around the edges thereof, with a neck extending from a side of the plastic film bag at the center of one side thereof, also showing the location of a zipper-like fastener element located inside the plastic film bag with a dotted line, and also showing a long tab secured by a thin adhesive disc to the plastic film bag;

FIG. 25 is a perspective view of a seventh alternate embodiment greeting card having two panels, with the gas generator illustrated in FIG. 24 located inside the second panel, with the pull tab extending from the top edge of the card between the plies of the second panel;

FIG. 26 is a side view of a swing-up trigger member;

FIG. 27 is a top plan view of a gas generator, showing a flat plastic film bag sealed around the edges thereof, with a neck extending from a side of the plastic film bag at the center of one side thereof, also showing the location of a zipper-like fastener element located inside the plastic film bag with a dotted line, and also showing the swing-up trigger member secured to the plastic film bag;

FIG. 28 is a perspective view of an eighth alternate embodiment greeting card having two panels, with the gas generator illustrated in FIG. 27 located inside the second panel, with the swing-up trigger member extending through an aperture in the top ply of the second panel;

FIG. 29 is a side view of a spring-loaded hinge trigger member in a first position, showing a biasing spring used to bias the hinge trigger member from the first position to a second position;

DETAILED DESCRIPTION OF THE PREFERRED EMBODIMENT

The present invention is illustrated herein by way of a number of examples in which a greeting card is provided with a self-inflating balloon contained therein. In the preferred embodiments, the balloon inflates upon opening the greeting card. Alternate embodiments are provided for initiating the inflation of the balloon upon removing the greeting card from an envelope, or even upon manual activation by the individual receiving the greeting card. While the inflation mechanism is essentially identical in all of the embodiments, the examples provide show how the triggering mechanism may vary. FIGS. 1 through 11 show the preferred embodiment, while FIGS. 12 through 28 show a variety of alternate embodiments.

Figure 1:
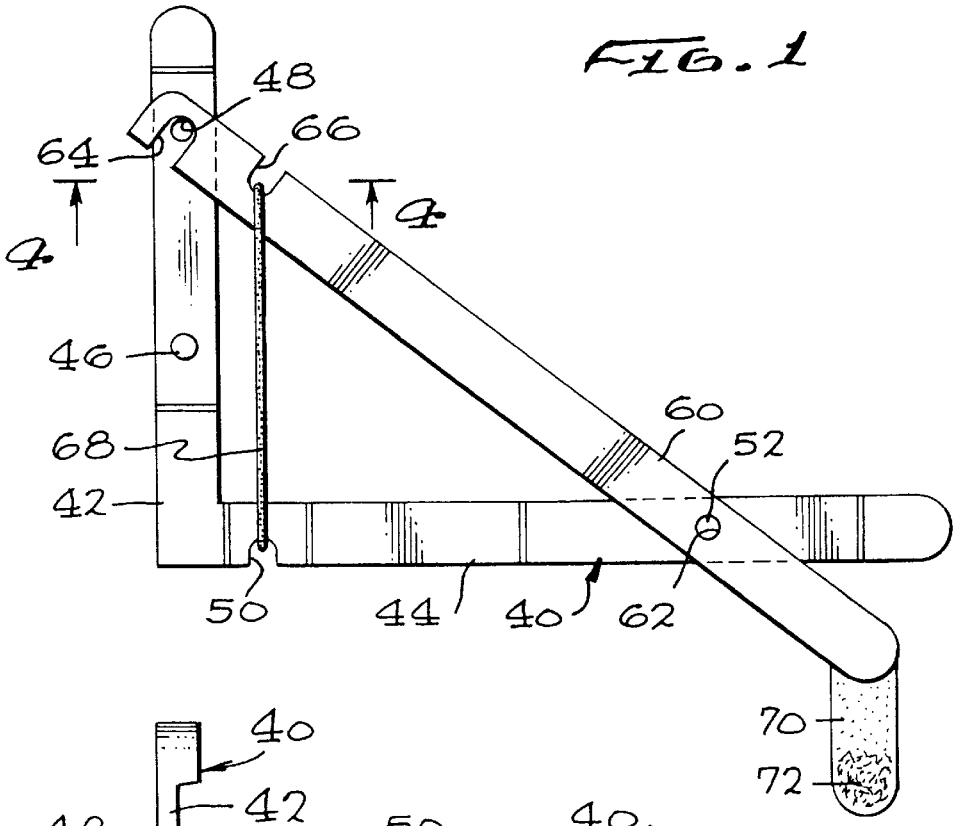
FIG. 1 is a plan view of the preferred embodiment triggering mechanism for the balloon greeting card of the present invention, showing a lever arm pivotably mounted on an L-shaped base member, with a rubber band used to bias the lever arm in a counter-clockwise direction.
Figure 2:
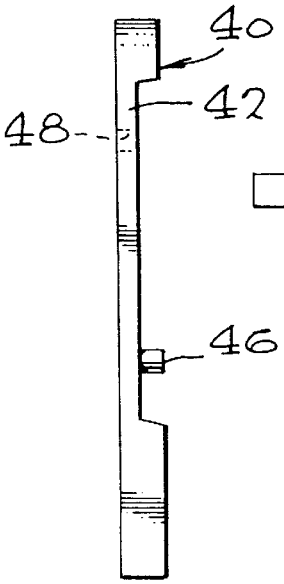
FIG. 2 is a first side view of the L-shaped base member illustrated in FIG. 1, showing a stop pin extending from the shorter arm of the L-shaped base member.
Figure 3:
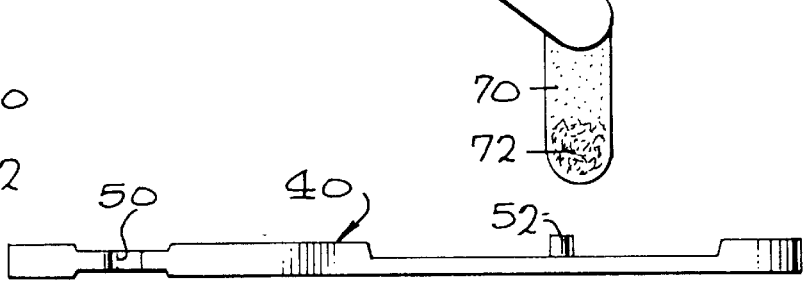
FIG. 3 is a second side view of the L-shaped base member illustrated in FIGS. 1 and 2, showing a pivot pin extending from the longer arm of the L-shaped base member.
Figure 4:
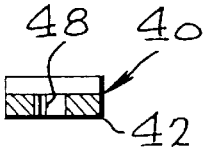
FIG. 4 is a cross-sectional view of the L-shaped base member illustrated in FIGS. 1 through 3, showing an aperture located in the shorter arm of the L-shaped base member.

Referring first to FIGS. 1 through 4, the triggering mechanism for the preferred embodiment of the balloon greeting card of the present invention is illustrated. An L-shaped base member 40 is shown which consists of a shorter arm 42 and a longer arm 44. The shorter arm 42 of the L-shaped base member 40 has a stop pin 46 extending from the top side thereof approximately one-third of the way from the end thereof which is connected to the longer arm 44. The shorter arm 42 also has an aperture 48 extending therethrough from the top side as best shown in FIGS. 1 and 4.

The longer arm 44 of the L-shaped base member 40 has a notch 50 therein which is located close adjacent to its point of attachment to the shorter arm 42, and in the side of the longer arm 44 further from the aperture 48 in the shorter arm 42. The portion of the longer arm 44 adjacent the notch 50 is recessed slightly on both the top side and the bottom side thereof, as best shown in FIG. 3. The longer arm 44 also has a pivot pin 52 extending from the top side thereof approximately two-thirds of the way from the end thereof which is connected to the shorter arm 42, as best shown in FIGS. 1 and 3.

Referring now to FIG. 1, a lever arm 60 is illustrated which is pivotably mounted on the pivot pin 52 on the L-shaped base member 40. The lever arm 60 has an aperture 62 located in the top side thereof approximately three-quarters of the way along its length, which aperture 62 receives the pivot pin 52 of the L-shaped base member 40 therein to allow the lever arm 60 to pivot thereabout.

Located near the end of the lever arm 60 furthest from the aperture 62 are a pair of longitudinally spaced-apart notches 64 and 66, which are located on opposite sides of the lever arm 60. The notch 64 is located closer to that end of the lever arm 60 than is the notch 66. The notch 66 in the lever arm 60 faces away from the notch 50 in the L-shaped base member 40, and a rubber band 68 extends between the notch 66 in the lever arm 60 and the notch 50 in the L-shaped base member 40. The rubber band 68 is used to bias the lever arm 60 in a counter-clockwise direction about the pivot pin 52 on the L-shaped base member 40. (Note that another biasing mechanism such as a spring or the like could be used instead of the rubber band 68.) The notch 64 travels in an arc about the pivot pin 52, which intersects the axis of the aperture 48 in the L-shaped base member 40.

Extending from the end of the lever arm 60 opposite the notches 64 and 66 is a flexible tab 70 which has a first mating strip 72 attached thereto, which first mating strip 72 faces up. The preferred embodiment of the present invention uses a mating strip-type material (similar to a Velcro® mating strips, Velcro® being a registered trademark of Velcro Industries, B.V.). This material is essentially a male and female type of fastener, with the female portion being a strip of material with curly strands or loops of material on the outer surface, and the male portion being a strip of material with a large number of flexible resilient plastic hooks on the outer surface, as illustrated in U. S. Pat. No. 3,063,718, to Steincamp. When the male and female strips of material are pressed against one another, the hooks in the male strip become entangled with the loops in the female strip, retaining the two strips together until they are forced apart. (Note that instead of male and female mating strips, double-sided tape could also be used.)

Note that the first mating strip 72 may be either the male strip or the female strip, it being understood that when a second mating strip is defined herein it is always the opposite of the first mating strip.

Figure 5:
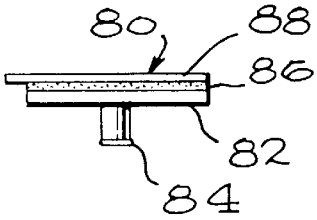
FIG. 5 is a side view of a triggering member having a trigger pin extending from a flat trigger base, showing an adhesive pad and peelable protector strip therefor located on the side of the trigger base opposite the trigger pin.

Referring next to FIG. 5, a triggering member 80 is illustrated which includes a flat trigger base 82 having a trigger pin 84 extending therefrom. The flat trigger base 82 has a thin adhesive pad 86 mounted thereon, the adhesive pad 86 having adhesive surfaces on both sides thereof. A peelable protector strip 88 is located on the side of the adhesive pad 86 opposite the flat trigger base 82. It will be appreciated by those skilled in the art that by removing the peelable protector strip 88 from the adhesive pad 86, the adhesive pad 86 may be used to secure the triggering member 80 to a desired surface.

Figure 7:
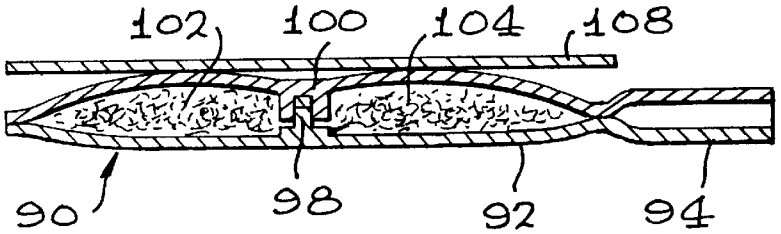
FIG. 7 is a cross-sectional view of the gas generator illustrated in FIG. 6, showing the zipper-like fastener element inside the plastic film bag in a closed position, also showing two reactants located inside the plastic film bag on opposite sides of the zipper-like fastener element, and also showing a reinforcing member secured to the bottom side of the gas generator.
Figure 6:
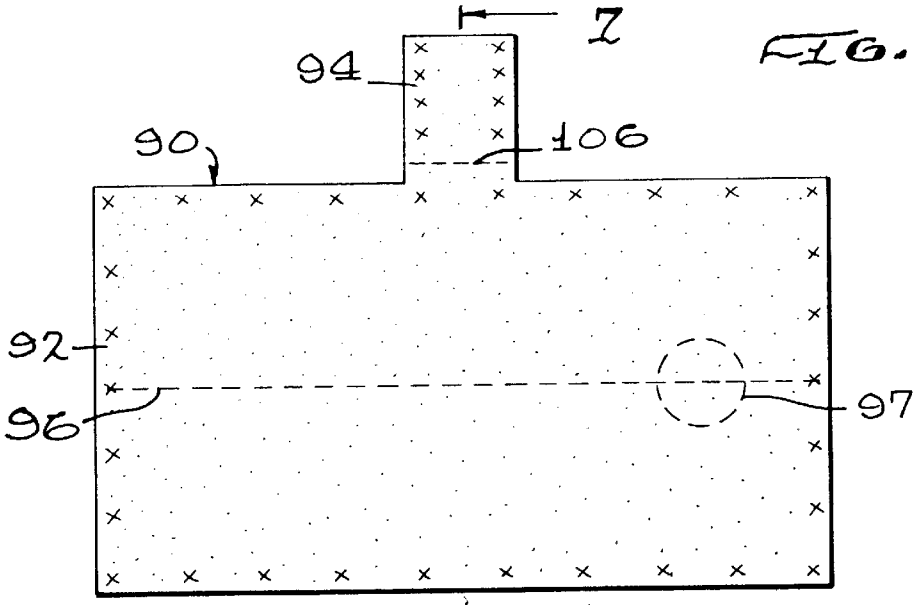
FIG. 6 is a back plan view of a gas generator, showing a flat plastic film bag sealed around the edges thereof (the sealed edges being illustrated by a series of X's), with a neck extending from a side of the plastic film bag at the center of one side thereof, the neck having an internal septum at a location illustrated by a dotted line, also showing the location of a zipper-like fastener element located inside the plastic film bag with a dotted line, and also showing the location of a mating strip located on the opposite side of the plastic film bag with a dotted line.

Referring next to FIGS. 6 and 7, a gas generator 90 is illustrated. The gas generator 90 comprises a thin plastic film bag 92 having a neck 94 extending from the plastic film bag 92 at the center of one side thereof. (Note that other thin, flexible materials like polyester film, such as the material marketed by DuPont under the trademark MYLAR, could be used instead of plastic.) The plastic film bag 92 and the neck 94 are sealed as a unit around the edges thereof (the sealed edges being illustrated by a series of X's), and are open only at the side of the neck 94 furthest away from the plastic film bag 92. The interior of the plastic film bag 92 and the interior of the neck 94 are in fluid communication, so the only way into or out of the plastic film bag 92 is through the neck 94.

The plastic film bag 92 is separated into two halves by an openable sealing member located within the plastic film bag 92, the location of which is indicated by a dotted line 96 in FIG. 6. A dotted line circle 97 is used to indicate the location of a second mating strip located on the front side of the plastic film bag 92 directly over the dotted line 96. This second mating strip will be discussed below in conjunction with FIG. 9.

In the preferred embodiment, a ribbed, zipper-like fastener element is used in the preferred embodiment. This type of fastener consists of a rectangular cross-sectional male zipper fastener member 98 which fits into a U-shaped cross-sectional female zipper fastener member 100, both shown in FIG. 7. When the male zipper fastener member 98 and the female zipper fastener member 100 are pressed together as shown, they establish a seal between the two sides of the plastic film bag 92.

Located in the plastic film bag 92 on the side of the zipper-like fastener element further from the neck 94 is a first reactant material 102. Located in the plastic film bag 92 on the side of the zipper-like fastener element closer to the neck 94 is a second reactant material 104. An internal septum, the location of which is indicated by a dotted line 106, may be located inside the neck 94 near its point of attachment to the plastic film bag 92. The internal septum is used to retain the second reactant material 104 in the plastic film bag 92, until the plastic film bag 92 is ruptured by pressure therein.

Optionally, a reinforcing member 108 may be mounted on the back side of the gas generator 90 as illustrated in FIG. 7. The reinforcing member 108 is a flat segment of heavy paperboard material, and is glued onto the back side of the plastic film bag 92 as shown. The reinforcing member 108 will act to prevent the gas generator 90 from unintentionally inflating by supporting the female zipper fastener member 100 thereon. It also eases the split of the zipper-like fastener element when the gas generator 90 is actuated.

In the preferred embodiment, the reactants used are an acid material and an alkaline material, which, when mixed, will generate carbon dioxide gas. The preferred alkaline material may be sodium bicarbonate or sodium hydrogencarbonate, and the preferred acidic solution may be materials such as vinegar, tartaric acid, or citric acid. Thus, for example, the first reactant material 102 may be sodium bicarbonate and citric acid (both in powder form, for example in approximately a 2:1 ratio by weight of sodium bicarbonate to citric acid), while the second reactant material 104 may be vinegar.

It will be appreciated by those skilled in the art that when the male zipper fastener member 98 and the female zipper fastener member 100 are pulled apart, the first reactant material 102 and the second reactant material 104 will mix, generating pressure which will rupture the internal septum in the neck 94 of the gas generator 90. Thus, until some force pulls the male zipper fastener member 98 and the female zipper fastener member 100 apart, the gas generator 90 will be inactive.

Figure 8:
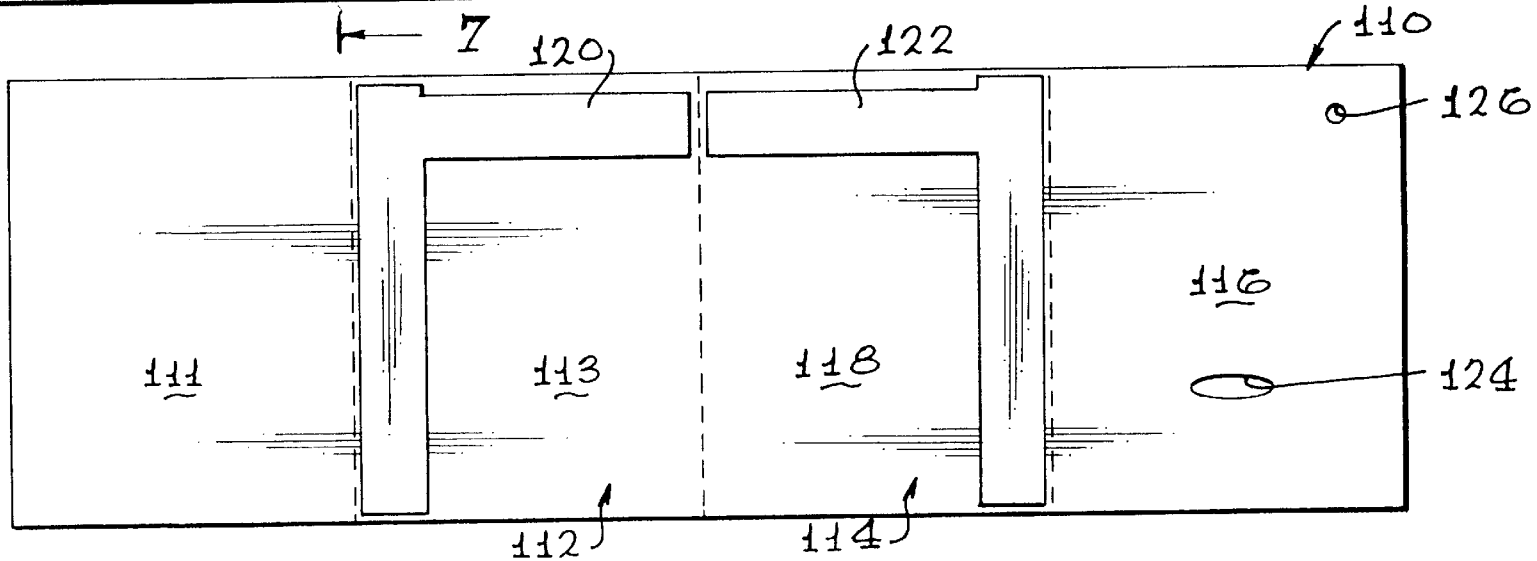
FIG. 8 is a plan view of a segment of paper sheet material used to form the two panels of a greeting card, the first panel and the second panel both being of two ply construction, showing an elliptical aperture in the top ply of the second panel through which the neck extending from the plastic film bag (shown in FIG. 6) will extend, also showing a small aperture in the top ply of the second panel through which the triggering pin of the triggering member (shown in FIG. 5) will extend, and also showing two segments of paper reinforcement material which may optionally be used to strengthen the two panels.

Referring next to FIG. 8, a segment of paper sheet material 110 is illustrated as being used to form two panels of a greeting card. A first panel 112 is formed of a bottom ply 111 which will be folded over onto a top ply 113, while a second panel 114 is formed of a top ply 116 which will be folded over onto a bottom ply 118. Note that either or both of the first and second panels 112 and 114 could also be of one ply construction if desired. A first segment of paper reinforcement material 120 is adhesively secured to the top ply 113 of the first panel 112, and a second segment of paper reinforcement material 122 is adhesively secured to the bottom ply 118 of the second panel 114.

An elliptical aperture 124 is located in the top ply 116 of the second panel 114 approximately one-third of the way from the bottom edge to the top edge of the top ply 116. The neck 94 of the gas generator 90 (FIG. 6) will extend through the elliptical aperture 124. A small aperture 126 is located in the top ply 116 of the second panel 114 near the top and outside edges thereof. The trigger pin 84 of the triggering member 80 (FIG. 5) will be placed through the aperture 126 in the top ply 116 of the second panel 114.

Figures 9, 10, 11:
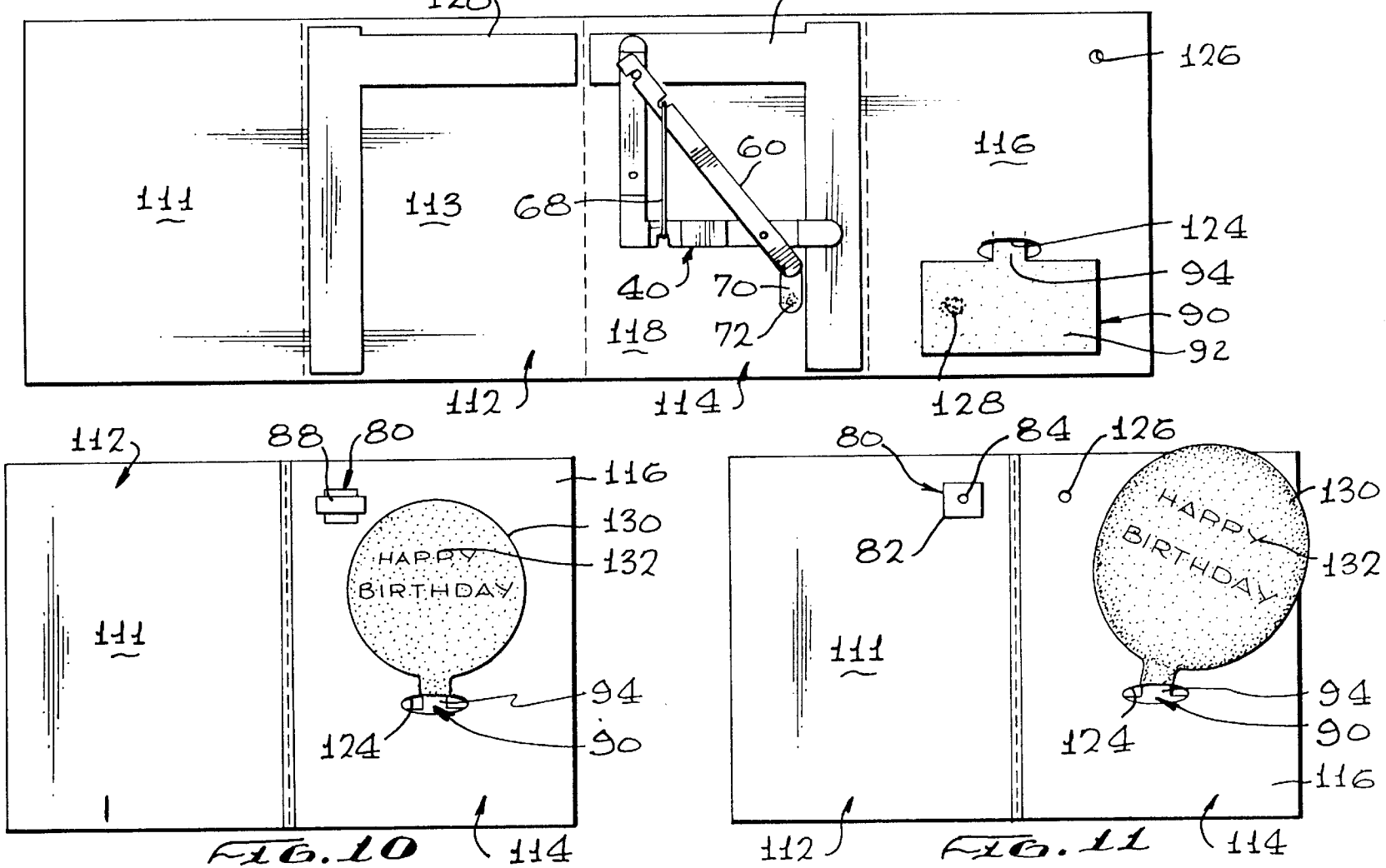
FIG. 9 is a plan view showing the triggering mechanism illustrated in FIG. 1 installed on the top side of the bottom ply of the second panel, and also showing the gas generator illustrated in FIG. 6 installed on the bottom side of the top ply of the second panel.
FIG. 10 is a plan view illustrating the apparatus shown in FIG. 9 with the bottom ply of the first panel folded over on the bottom of the top ply of the first panel, and with the top ply of the second panel folded over on top of the bottom ply of the second panel, also showing a balloon connected to the neck of the plastic film bag and in fluid communication therewith, the balloon having greeting indicia thereon, and also showing the triggering member (shown in FIG. 5) in its safety position to prevent activation of the gas generator (FIG. 9), the peelable protector strip being shown prior to its removal to expose the adhesive pad to allow the greeting card to be armed by folding the first panel over onto the second panel.
FIG. 11 is a plan view of the greeting card illustrated in FIG. 10, following it being triggered to activate the gas generator (FIG. 9) and inflate the balloon.

Referring next to FIG. 9, the triggering mechanism illustrated in FIG. 1 is secured to the top side of the bottom ply 118 of the second panel 114 by adhesively securing the L-shaped base member 40 to the second panel 114 in the upper portion thereof. The back side of the gas generator 90 is adhesively secured to the bottom side of the top ply 116 of the second panel 114 with the neck 94 extending through the elliptical aperture 124 in the top ply 116 to the front side of the top ply 116. If the optional reinforcing member 108 (shown in FIG. 7) is used, it is adhesively secured to the bottom side of the top ply 116 of the second panel 114 to mount the gas generator 90 onto the bottom side of the top ply 116 of the second panel 114.

Referring now to FIGS. 9 and 10, the bottom ply 111 of the first panel 112 is folded over onto the top ply 113 of the first panel 112, where it will be held adhesively, thereby forming the first panel 112.

It will be noted that when the lever arm 60 is in the armed position it is illustrated in both in FIG. 1 and in FIG. 9 (with the rubber band 68 stretched to bias the lever arm 60 in a counter-clockwise direction), the first mating strip 72 on the triggering mechanism is aligned with a second mating strip 128 on the front side of the gas generator 90. Thus, when the top ply 116 is folded over onto the bottom ply 118 to form the second panel 114 (where it will be held adhesively), the first mating strip 72 and the second mating strip 128 will contact each other.

As the second panel 114 is so assembled, the lever arm 60 is retained in the position shown until the triggering member 80 can be used to retain the lever arm 60 in that position. Referring now to FIGS. 1, 9, and 10, the trigger pin 84 of the triggering member 80 is inserted through the aperture 126 in the top ply 116 of the second panel 114 and into the aperture 48 in the shorter arm 42 of the L-shaped base member 40. In this position, the trigger pin 84 of the triggering member 80 will be engaged by the notch 64 in the lever arm 60, thereby retaining the lever arm 60 in the armed position until the trigger pin 84 of the triggering member 80 is removed to allow the rubber band 68 to rotate the lever arm 60 counter-clockwise, pulling the tab 70 and thereby opening the zipper-like fastener element on the gas generator 90.

A balloon 130 is adhesively secured to the neck 94 of the gas generator 90 just above the elliptical aperture 124. Thus, the interior of the gas generator 90 and the interior of the balloon 130 are in fluid communication. When the gas generator 90 generates pressurized gas, the balloon 130 will be inflated. Note that the balloon 130 has greeting indicia 132 located thereon.

The greeting card illustrated in FIG. 10 is complete and ready to use. The sender may inscribe a personal greeting on the card if so desired. To arm the greeting card, the peelable protector strip 88 is removed from the adhesive pad 86 (FIG. 5) on the triggering member 80. Then, when the first panel 112 is folded over onto the second panel 114, the adhesive pad 86 will adhere to the back side of the first panel 112.

The next time the card is opened by opening the first panel 112 away from the second panel 114 as shown in FIG. 11, the triggering member 80 will move with the first panel 112, causing the trigger pin 84 of the triggering member 80 (FIG. 5) to come out of the aperture 126 in the top ply 116 of the second panel 114. As the trigger pin 84 of the triggering member 80 does so, it is removed from the aperture 48 in the shorter arm 42 of the L-shaped base member 40 (FIG. 1), allowing the lever arm 60 (FIG. 1) to be rotated counter-clockwise by the rubber band 68 (FIG. 1), thereby activating the gas generator 90 (FIG. 9) and inflating the balloon 130.

Figure 12:
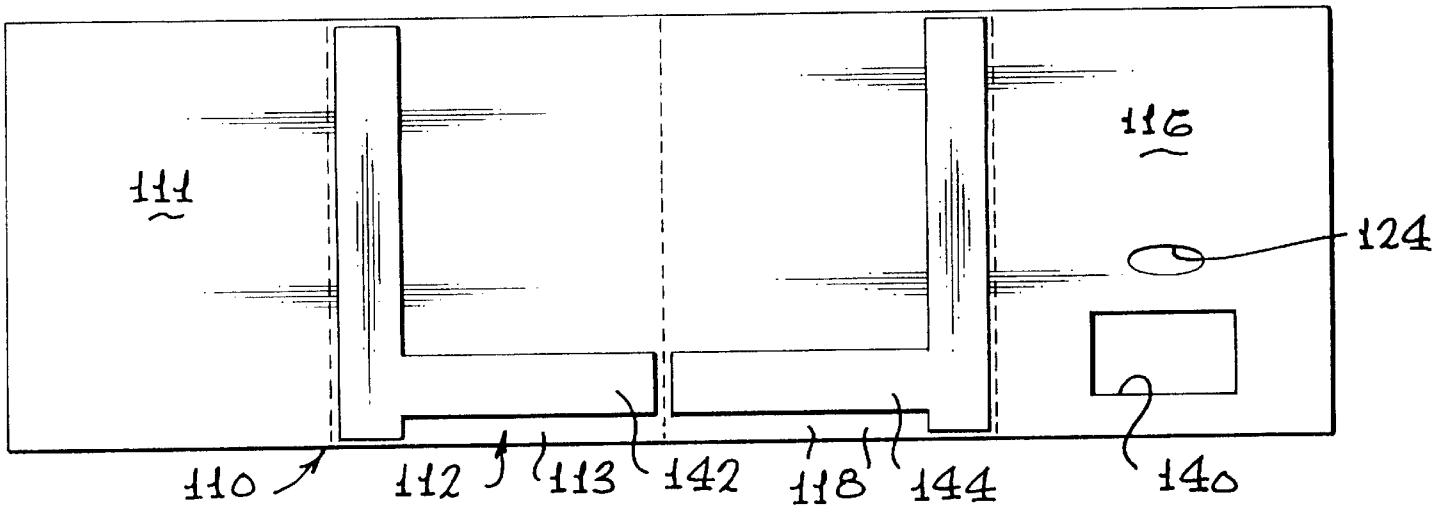
FIG. 12 is a plan view of a segment of paper sheet material used to form the two panels of a first alternate embodiment greeting card, the first panel and the second panel both being of two ply construction, showing an elliptical aperture in the front ply of the second panel through which the neck extending from the plastic film bag (shown in FIG. 6) will extend, also showing a rectangular aperture in the front ply of the second panel which will expose a portion of a plastic film bag (not shown) which will be mounted on the back side of the front ply of the second panel, and also showing two segments of paper reinforcement material which may optionally be used to strengthen the two panels.
Figure 14:
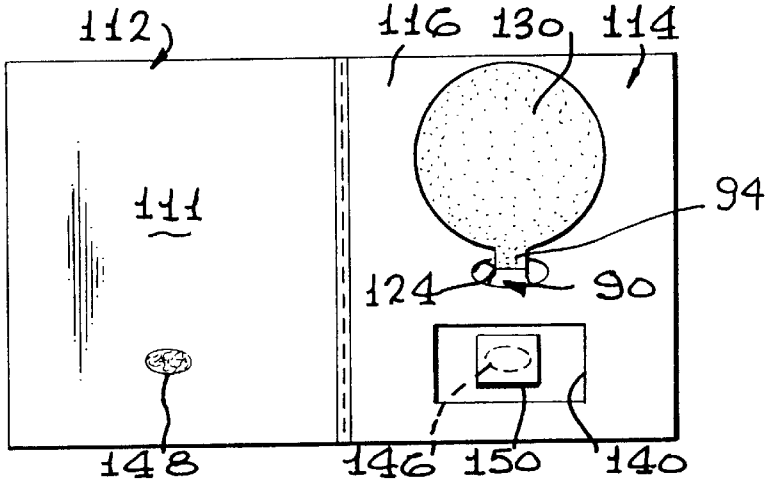
FIG. 14 is a plan view illustrating the apparatus shown in FIG. 12 with the bottom ply of the first panel folded over on the bottom of the top ply of the first panel, and with the top ply of the second panel folded over on top of the bottom ply of the second panel, also showing the gas generator illustrated in FIG. 13 installed between the two plies of the second panel, showing a balloon connected to the neck of the plastic film bag and in fluid communication therewith, and also showing a mating strip located on the bottom of the first panel.
Figure 13:
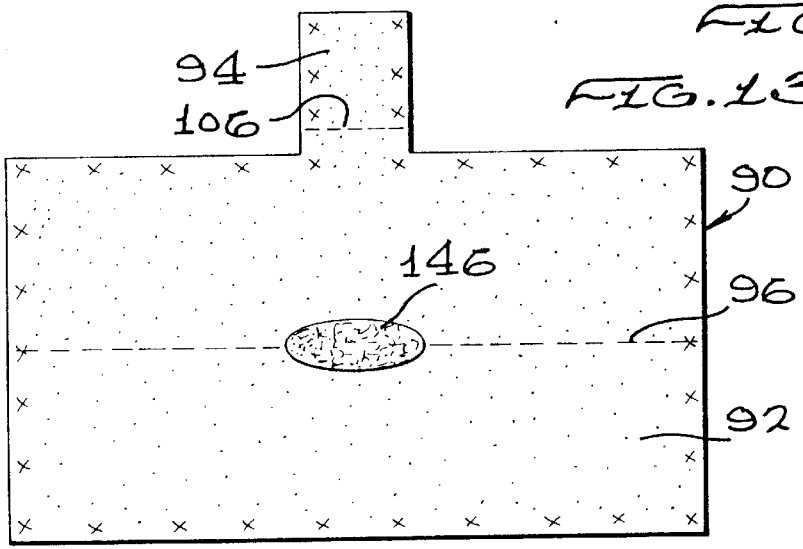
FIG. 13 is a front plan view of a gas generator, showing a flat plastic film bag sealed around the edges thereof (the sealed edges being illustrated by a series of X's), with a neck extending from a side of the plastic film bag at the center of one side thereof, the neck having an internal septum at a location illustrated by a dotted line, also showing the location of a zipper-like fastener element located inside the plastic film bag with a dotted line, and also showing a mating strip located on the plastic film bag.

The first of the alternate embodiments depicted herein is shown in FIGS. 12 through 14. The description of like components and similar operations in the alternate embodiments will be abbreviated, it being understood that the same principles as presented above with regard to the preferred embodiment are also applicable to the alternate embodiments. Like components are also given the same reference numbers, with only different features being assigned additional reference numbers.

In FIG. 12, the segment of paper sheet material 110 is shown with a few differences from the depiction of FIG. 8. First, it will be noted that the aperture 126 is not present in the top ply 116 of the second panel 114. Secondly, a rectangular aperture 140 is located in the top ply 116 of the second panel 114 below the elliptical aperture 124. A first segment of paper reinforcement material 142 having a different configuration than the first segment of paper reinforcement material 120 (shown in FIG. 9) is adhesively secured to the top ply 113 of the first panel 112. Also, a second segment of paper reinforcement material 144 having a different configuration than the second segment of paper reinforcement material 122 (shown in FIG. 9) is adhesively secured to the bottom ply 118 of the second panel 114.

Referring next to FIG. 13, the gas generator 90 is shown with a second mating strip 146 on the front side of the plastic film bag 92 directly over the dotted line 96 instead of the second mating strip 128 on the front side of the plastic film bag 92. When the back side of the gas generator 90 is adhesively secured to the top side of the bottom ply 118 (shown in FIG. 12) of the second panel 114, the second mating strip 146 will be located in the center of the rectangular aperture 140 in the top ply 116 of the second panel 114. Note that the optional reinforcing member 108 (illustrated in FIG. 7) may be mounted on the back side of the gas generator 90, if desired.

Referring now to FIG. 14, a first mating strip 148 located on the bottom side of the bottom ply 111 of the first panel 112 is aligned with the second mating strip 146 on the gas generator 90. A protective cover strip 150 is placed over the second mating strip 146 on the gas generator 90 when the card is manufactured. To arm the card, the protective cover strip 150 is removed from the second mating strip 146 on the gas generator 90. Then, when the first panel 112 is folded over onto the second panel 114, the first mating strip 148 will adhere to the second mating strip 146. The next time the card is opened by opening the first panel 112 away from the second panel 114, the gas generator 90 will be activated to inflate the balloon 130.

FIGS. 15 and 16 show a second alternate embodiment. In FIG. 15, a string 162 has one end fastened to the bottom of the gas generator 90 over the dotted line 160 (signifying the zipper-like fastener element) with a thin adhesive disc 164. Note that the optional reinforcing member 108 (illustrated in FIG. 7) may be mounted on the back side of the gas generator 90, if desired.

Referring next to FIG. 16, the top ply 116 of the second panel 114 is seen to have an aperture 166 located below and to the right of the elliptical aperture 124. The string 162 extends through the aperture 166, and the other end of the string 162 is fastened to the bottom ply 111 of the first panel 112 with a thin adhesive disc 168. Note that the point of attachment of the other end of the string 162 with the thin adhesive disc 168 is spaced away from the line of attachment of the first panel 112 to the second panel 114. (If it is not so spaced away, the string 162 will not be pulled when the first panel 112 is opened away from the second panel 114.)

Note that the card may be partially opened without activating the gas generator 90. However, when the card is fully opened by opening the first panel 112 away from the second panel 114, the string 162 will be drawn taught, and the gas generator 90 will be activated to inflate the balloon 130.

FIG. 17 shows a third alternate embodiment using a pull tab 170 instead of the string 162 in FIGS. 15 and 16. The pull tab 170 is relatively stiff, unlike the string 162. The operation is the same however, and when the card is fully opened by opening the first panel 112 away from the second panel 114, the pull tab 170 will cause the gas generator 90 to be activated to inflate the balloon 130.

FIG. 18 depicts a fourth alternate embodiment which, unlike the previous embodiments of the present invention, does not activate the gas generator 90 to inflate the balloon 130 when the card is opened. Rather, in FIG. 18, when the card is removed from an envelope 180, the gas generator 90 is activated to inflate the balloon 130. The construction is similar to that illustrated in FIG. 16, with an additional aperture 182 located at the line of attachment of the first panel 112 to the second panel 114. The string 162 extends through the aperture 182, with the other end of the string 162 being secured inside the envelope 180 with a thin adhesive disc 184. When the card is removed from the envelope 180, the string 162 will be drawn taught, and the gas generator 90 will be activated to inflate the balloon 130.

Figure 19:
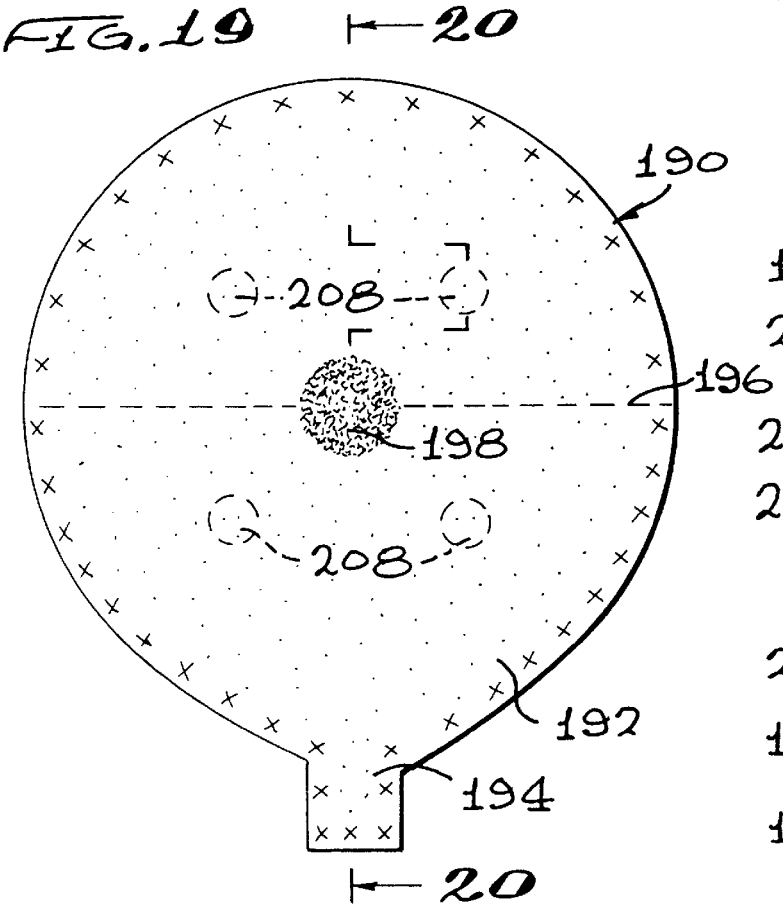
FIG. 19 is a top plan view of a combination balloon and gas generator, showing a flat balloon sealed around the edges thereof (the sealed edges being illustrated by a series of X's), with a neck extending from a side of the flat balloon at the bottom thereof, the neck having an internal septum at a location illustrated by a dotted line, showing the location of a zipper-like fastener element located inside the balloon with a dotted line, also showing the location of glue spots located inside the balloon with dotted lines, and also showing a mating strip located on the balloon.
Figure 20:
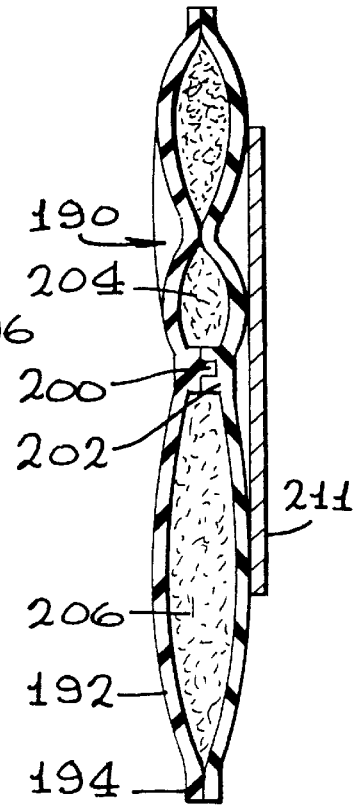
FIG. 20 is a cross-sectional view of the combination balloon and gas generator illustrated in FIG. 19, showing the zipper-like fastener element inside the balloon in a closed position, also showing two reactants located inside the balloon on opposite sides of the zipper-like fastener element, and also showing a reinforcing member secured to the bottom side of the balloon.
Figure 21:
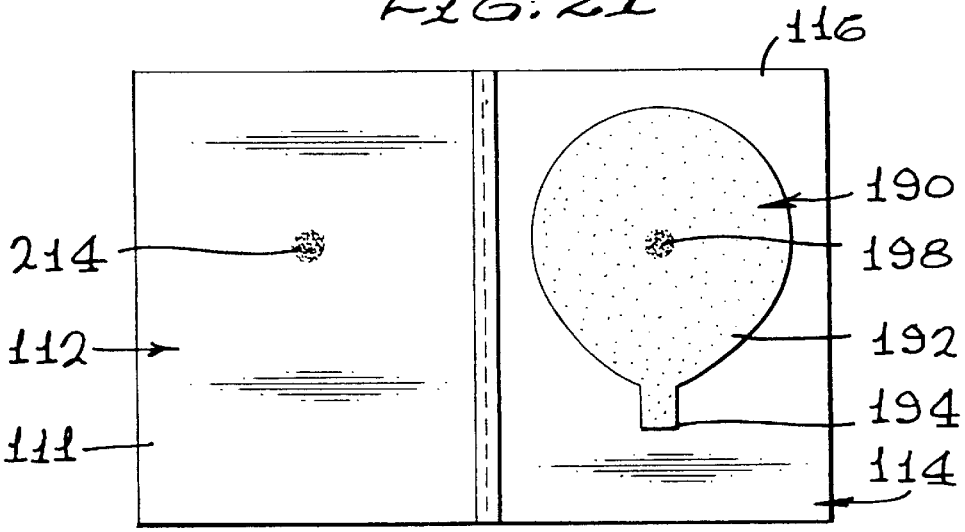
FIG. 21 is a plan view of a fifth alternate embodiment greeting card having two two ply panels, with the combination balloon and gas generator illustrated in FIGS. 19 and 20 being secured to the top of the second panel, also showing a mating strip located on the bottom of the first panel.

Referring next to FIGS. 19 through 21, a fifth alternate embodiment is illustrated. Like the preferred embodiment and the first three alternate embodiments, the embodiment illustrated in FIGS. 19 through 21 is designed to activate the gas generator 90 to inflate the balloon 130 when the card is opened. However, in this embodiment, the gas generator 90 and the balloon 130 are combined into a single hybrid unit 190, the construction of which is illustrated in FIGS. 19 and 20.

The combination balloon and gas generator 190 comprises a thin plastic film balloon 192 having a neck 194 extending from the bottom end thereof. The plastic film balloon 192 and the neck 194 are sealed as a unit around the edges thereof (the sealed edges being illustrated by a series of X's) during manufacture of the plastic film balloon 192.

The plastic film balloon 192 is separated into two halves by an openable sealing member located within the plastic film balloon 192, the location of which is indicated by a dotted line 196 in FIG. 19. A second mating strip 198 is located on the front side of the plastic film balloon 192 directly over the dotted line 196.

A ribbed, zipper-like fastener element is used in this embodiment, as shown in FIG. 20. A rectangular cross-sectional male zipper fastener member 200 fits into a U-shaped cross-sectional female zipper fastener member 202. When the male zipper fastener member 200 and the female zipper fastener member 202 are pressed together as shown, they establish a seal between the two sides of the plastic film balloon 192.

Located in the plastic film balloon 192 on the side of the zipper-like fastener element further from the neck 194 is a first reactant material 204. Located in the plastic film balloon 192 on the side of the zipper-like fastener element closer to the neck 194 is a second reactant material 206. Following the reactants being placed into the plastic film balloon 192 during the manufacture process, the plastic film balloon 192 is sealed shut. It will thus be apparent that the neck 194 is for appearances only, and is not used in the operation of the device.

Referring again to FIG. 19, four dotted line circles 208 are illustrated to indicate the location of glue spots located inside the plastic film balloon 192. These internal glue spots are used to cause resistance when the second mating strip 198 is pulled upwardly away from the plastic film balloon 192, as will be discussed below.

Optionally, a reinforcing member 211 may be mounted on the back side of the gas generator 190 as illustrated in FIG. 7. The reinforcing member 211 is a flat segment of heavy paperboard material, and is glued onto the back side of the balloon 192 as shown. The reinforcing member 211 will act to prevent the gas generator 190 from prematurely inflating by supporting the female zipper fastener member 202 thereon. It also eases the split of the zipper-like fastener element when the gas generator 190 is actuated.

Referring now to FIG. 21, the combination balloon and gas generator 190 is shown mounted onto the second panel 114, using four glue spots underneath the combination balloon and gas generator 190 in locations corresponding to the internal glue spots indicated by the dotted line circles 208 in FIG. 19. Note that the first and second panels 112 and 114 may be of two ply construction as shown, or of one ply construction if so desired. If the optional reinforcing member 211 (shown in FIG. 20) is used, it is adhesively secured to the second panel 114 to mount the gas generator 190 onto the second panel 114.

A first mating strip 214 located on the back side of the first panel 112 is aligned with the second mating strip 198 on the combination balloon and gas generator 190. A protective cover strip (not shown in FIG. 21) may be placed over the first mating strip 214 when the card is manufactured. To arm the card, the protective cover strip would be removed from the first mating strip 214. Then, when the first panel 112 is folded over onto the second panel 114, the first mating strip 214 will adhere to the second mating strip 198. The next time the card is opened by opening the first panel 112 away from the second panel 114, the combination balloon and gas generator 190 will be activated and inflated. The internal glue spots are used to provide resistance causing the second mating strip 198 to be pulled off of the first mating strip 214 after the combination balloon and gas generator 190 is activated. As the plastic film balloon 192 inflates, the internal glue spots will break apart and the internal septum in the neck 194 will rupture, allowing the plastic film balloon 192 to fully inflate.

FIGS. 22 through 28 illustrate three additional embodiments in which the gas generator 90 is activated to inflate the balloon 130 manually by the recipient of the card. FIGS. 22 and 23 show a sixth alternate embodiment using the gas generator 90 illustrated in FIG. 6, but slightly modified. No mating strip is mounted on the gas generator 90 in FIG. 22. Rather, a pull tab 220 has one end fastened to the bottom of the gas generator 90 over the dotted line 96 (which defines the location of the openable sealing member as in FIG. 6) with a thin adhesive segment 222. Note that the optional reinforcing member 108 (illustrated in FIG. 7) may be mounted on the back side of the gas generator 90, if desired.

Referring now to FIG. 23, the top ply 116 of the second panel 114 is seen to have an aperture 224 located below the elliptical aperture 124. The pull tab 220 extends through the aperture 224. An outline of a thumb 226 is located on the second panel 114 at the bottom and near the point of attachment to the first panel 112. By holding the card at the location indicated by the outline of a thumb 226 and pulling the pull tab 220 upwardly, the gas generator 90 will be activated to inflate the balloon 130.

FIGS. 24 and 25 show a seventh alternate embodiment using the gas generator 90 illustrated in FIG. 22, but slightly modified. Referring first to FIG. 24, instead of the relatively short pull tab 220 (shown in FIG. 22), a long pull tab 230 is used instead. Note that the optional reinforcing member 108 (illustrated in FIG. 7) may be mounted on the back side of the gas generator 90, if desired. Referring now to FIG. 25, it may be seen that the pull tab 230 extends from the top end of the second panel 114. By again holding the card at the location indicated by the outline of a thumb 226 and pulling the pull tab 230 upwardly, the gas generator 90 will be activated to inflate the balloon 130.

FIGS. 26 through 28 show an eighth alternate embodiment using the gas generator 90 illustrated in FIG. 6, but again slightly modified. Referring first to FIG. 26, a swing-up trigger member 240 is illustrated which has a small rectangular base member 242 having an L-shaped handle extending therefrom. Referring next to FIG. 27, the swing-up trigger member 240 is mounted by adhesively securing the base member 242 to the bottom of the gas generator 90 over the dotted line 96. Note that the optional reinforcing member 108 (illustrated in FIG. 7) may be mounted on the back side of the gas generator 90, if desired.

Referring now to FIG. 28, the top ply 116 of the second panel 114 is seen to have a rectangular aperture 246 located below the elliptical aperture 124. The swing-up trigger member 240 extends through the aperture 246. By pulling the swing-up trigger member 240 upwardly, the gas generator 90 will be activated to inflate the balloon 130.

Figure 31:
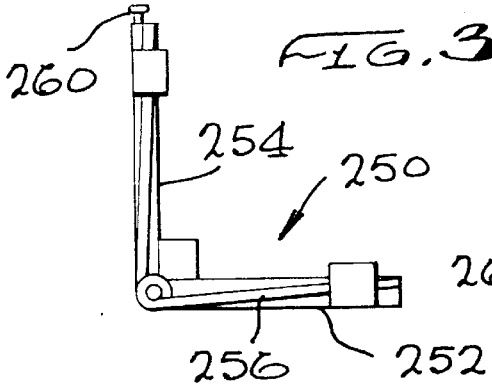
FIG. 31 is a side view of the spring-loaded hinge trigger member illustrated in FIGS. 29 and 30, showing the hinge trigger member in the second position.
Figure 30:
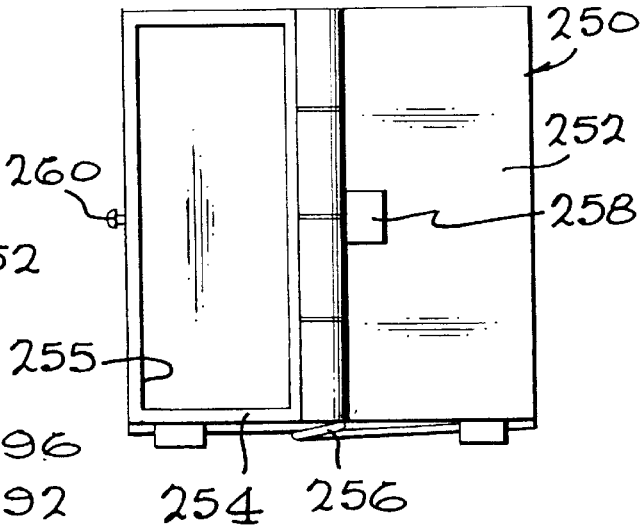
FIG. 30 is a top plan view of the spring-loaded hinge trigger member illustrated in FIG. 29, showing a pin extending from the side of the hinge trigger member.

FIGS. 29 through 33 show a ninth alternate embodiment using the gas generator 90 illustrated in FIG. 6, but again slightly modified. Referring first to FIGS. 29 through 31, a spring-loaded hinge trigger member 250 is illustrated which a first hinge plate 252 hingedly mounted to a second hinge plate 254. A spring 256 is used to bias the spring-loaded hinge trigger member 250 from the position shown in FIG. 29 to the position shown in FIG. 31. A stop 258 is mounted on the first hinge plate 252, and is used to prevent movement of the spring-loaded hinge trigger member 250 beyond the position illustrated in FIG. 31. A pin 260 is mounted on the edge of the second hinge plate 254 opposite the first hinge plate 252. Note that the second hinge plate 254 has a recessed area 255, which may be used to hold confetti (not shown in FIGS. 29 through 31), as will become apparent below.

Figure 32:
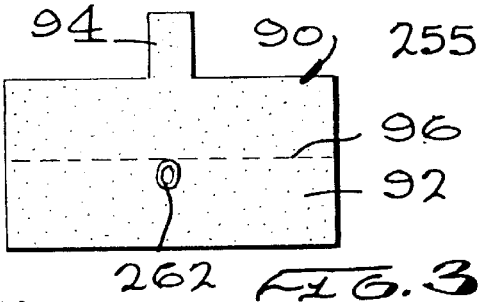
FIG. 32 is a top plan view of a gas generator, showing a flat plastic film bag sealed around the edges thereof, with a neck extending from a side of the plastic film bag at the center of one side thereof, also showing the location of a zipper-like fastener element located inside the plastic film bag with a dotted line, and also showing a rubber band adhesively secured to the plastic film bag.
Figure 33:
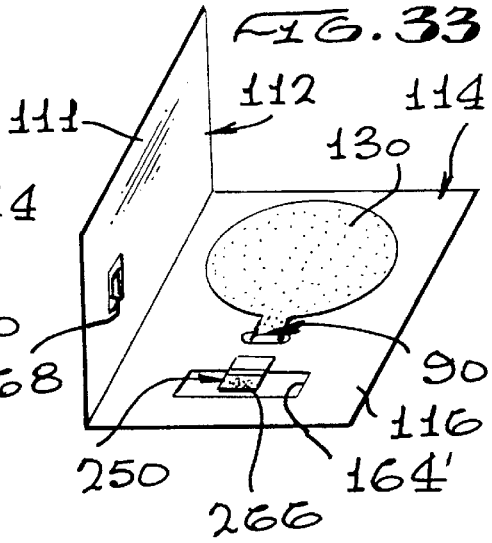
FIG. 33 is a perspective view of a ninth alternate embodiment greeting card having two panels, with the gas generator illustrated in FIG. 32 located inside the second panel, with one side of the spring-loaded hinge trigger member mounted onto the second panel with the other side of the spring-loaded hinge trigger member overlying the portion of the plastic film bag exposed through an aperture in the top ply of the second panel.

Referring next to FIG. 32, a small rubber band 262 is mounted adhesively to the top side of the gas generator 90 over the dotted line 96. Referring next to FIG. 33, the spring-loaded hinge trigger member 250 is mounted to the second panel 114 by adhesively securing the first hinge plate 252 to the second panel 114 adjacent an aperture 164 therein. The rubber band 262 is looped over the pin 260, and the first panel 112 is closed over the second panel 114.

When the first panel 112 is opened, the spring 256 (FIG. 30) will urge the spring-loaded hinge trigger member 250 to the second position illustrated in FIG. 31, pulling the rubber band 262 and activating the gas generator 90 to inflate the balloon 130. Optionally, confetti 266 may be placed in the recessed area 255 of the second hinge plate 254 prior to the card being closed. In this case, when the spring-loaded hinge trigger member 250 moves to the second position, the confetti 266 will be sprayed upwardly from the second panel 114. A shallow cup member 268 is mounted on the inside of the first panel 112, and will help retain the confetti 266 in the recessed area 255 of the second hinge plate 254 when the card is closed.

Figure 34:
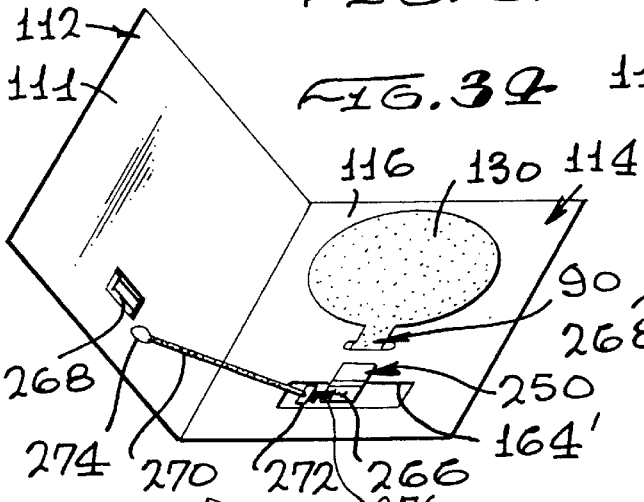
FIG. 34 is a perspective view of a tenth alternate embodiment greeting card similar to that shown in FIG. 33, but with an optional string extending from the first panel to a removable pin to trigger the spring-loaded hinge trigger member.

Referring next to FIG. 34, a tenth alternate embodiment is illustrated in which a string 270 has one end fastened to a pin 272. The other end of the string 270 is secured to the first panel 112 with a thin adhesive disc 274. The pin 272 is inserted through a retaining member 276 mounted to the left of the second hinge plate 254 of the spring-loaded hinge trigger member 250, with the pin 272 then fitting over the second hinge plate 254 to retain it in place. When the first panel 112 is opened away from the second panel 114, the pin 272 will be pulled from the retaining member 276, releasing the second hinge plate 254 and allowing the spring-loaded hinge trigger member 250 to move to the second position. Confetti 266 is sprayed upwardly from the second panel 114, and the gas generator 90 is activated to inflate the balloon 130, with the spring-loaded hinge trigger member 250 then spraying the confetti 266 upwardly from the second panel 114.

Figure 35:
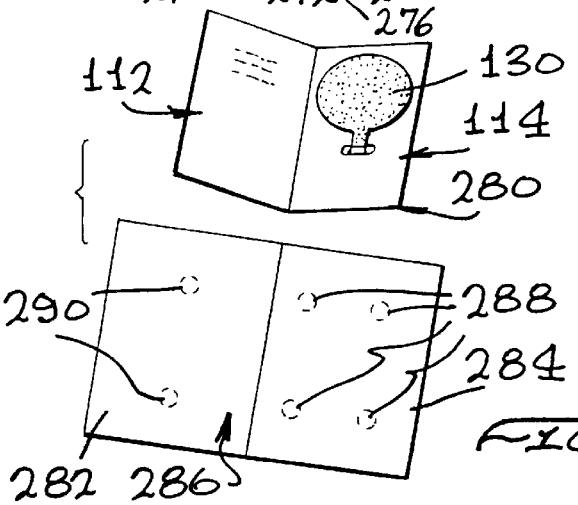
FIG. 35 is a perspective view of one of the greeting cards of the present invention showing it adhesively secured within the pages of a magazine for operation when the pages to which it is secured are opened apart.

Referring now to FIG. 35, one of the greeting cards of the present invention 280 is shown being adhesively secured within two adjacent pages 282 and 284 of a magazine 286. Four drops of glue 288 are used to secured the second panel 114 of the greeting card 280 to the page 284, and two drops of glue 290 are used to secure the first panel 112 of the greeting card 280 to the page 282. It will be appreciated that when the pages 282 and 284 of the magazine 286 are opened, the balloon 130 will be inflated. This technique may also be used with books or brochures in addition to magazines.

Figure 36:
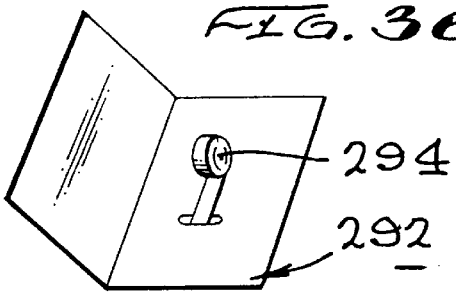
FIG. 36 is a perspective view of one of the greeting cards of the present invention having an inflatable party blow out instead of a balloon.

Referring finally to FIG. 36, one of the greeting cards of the present invention 292 is shown with an inflatable party blow out 294 which is used instead of the balloon 130 (not shown in FIG. 36). In operation, when the greeting card 292 is opened, the party blow out 294 will be inflated in exactly the same manner as the balloon 130 is inflated in the other embodiments described above.

It may therefore be appreciated from the above detailed description of the preferred embodiment of the present invention that it teaches an improved greeting card which contains a balloon therein, which balloon is automatically inflated when the card is opened by the recipient of the card. The mechanism for inflating the balloon when the card is opened is of simple and fool-proof construction. The triggering mechanism is not set when the card is purchased, but rather the individual sending the card is allowed to set the mechanism after writing a personal message inside the card. Further, the triggering mechanism is easy to set by the individual sending the card.

If desired, the balloon contained in the balloon greeting card of the present invention may bear a message which is displayed when the balloon is inflated following the recipient opening the card. In appearance, the balloon greeting card of the present invention resembles an ordinary greeting card, and is not unduly thick or bulky. The balloon greeting card of the present invention is safe for use by children, since the self-inflating mechanism does not use dangerous or unsafe materials. Further, the materials used for inflation of the balloon are also environmentally friendly.

The balloon greeting card of the present invention is of a construction which is dependable in operation and which has the capacity for extended storage prior to use, and the card does not require special storage conditions during its shelf life. The balloon greeting card of the present invention is of inexpensive construction to maximize its market appeal and to afford it the broadest possible market. Finally, all of the aforesaid advantages and objectives of the balloon greeting card of the present invention are achieved without incurring any substantial relative disadvantage.

It can be appreciated that the instant invention can be employed with books, magazines, brochures and the like, as well as with greeting cards.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A greeting card, comprising:

a first panel having a front side and a back side, said first panel also having top, bottom, and side edges;

a second panel having a front side and a back side, said second panel also having top, bottom, and side edges, one side edge of said first panel being hingedly interconnected to one side edge of said second panel such that said first panel is foldable between a first position in which said first panel lays close adjacent said second panel and a second position in which said first panel is opened away from said second panel;

a gas generating apparatus carried by said second panel, said gas generating apparatus having a charged state in which said gas generating apparatus is inactive, said gas generating apparatus also having an activated state in which said gas generating apparatus generates gas through a chemical reaction;

a triggering mechanism operatively connected to said first panel and to said gas generating apparatus, said triggering mechanism causing said gas generating apparatus to go from said charged state to said activated state when said triggering mechanism is actuated by the movement of said first panel from its first position to its second position, said triggering mechanism initially being armed for operation with said first panel being in its first position, said triggering mechanism subsequently being actuated and in response causing said gas generating apparatus to go from said charged state to said activated state when said first panel is initially moved from its first position to its second position; and an inflatable member, said inflatable member being in fluid communication with said gas generating apparatus such that said inflatable member is inflated when said gas generating apparatus generates gas.

2. A greeting card as defined in claim 1, wherein said second panel comprises first and second plies which are secured together to form said second panel.

3. A greeting card as defined in claim 2, wherein said gas generating apparatus is mounted intermediate said first and second plies.

4. A greeting card as defined in claim 2, wherein said first panel comprises third and fourth plies which are secured together to form said first panel.

5. A greeting card as defined in claim 1, additionally comprising:

at least one segments of paper reinforcement material for strengthening at least one of said first and second panels.

6. A greeting card as defined in claim 1, wherein said gas generating apparatus comprises:

a thin plastic film bag having a single outlet, said inflatable member being connected to and in fluid communication with said outlet;

a sealing member located within said plastic film bag, said sealing member having a closed position in which said plastic film bag is divided into two portions not in fluid communication with each other when said gas generating apparatus is inactive, said sealing member also having an open position in which said two portions of said plastic film bag are in fluid communication with each other when said gas generating apparatus is activated;

a first reactant material located in said first portion of said plastic film bag when said gas generating apparatus is inactive; and a second reactant material located in said second portion of said plastic film bag when said gas generating apparatus is inactive.

7. A greeting card as defined in claim 6, wherein said thin film bag is made of plastic.

8. A greeting card as defined in claim 6, wherein said thin film bag is made of polyester film.

9. A greeting card as defined in claim 6, wherein said sealing member comprises:

a zipper-like fastener element having a rectangular cross-sectional male zipper fastener member located on one side of said thin film bag which fits into a U-shaped cross-sectional female zipper fastener member located on the opposite side of said thin film bag.

10. A greeting card as defined in claim 9, wherein said triggering mechanism comprises:

means for opening said zipper-like fastener element.

11. A greeting card as defined in claim 9, wherein said triggering mechanism comprises:

a biased trigger mechanism carried by said second panel, said biased trigger mechanism being biased from a first position allowing said zipper-like fastener element to remain in said closed position to a second position pulling and opening said zipper-like fastener element; and a triggering member for selective engagement with said biased trigger mechanism to retain said biased trigger mechanism in said first position, said triggering member for selective attachment to said first panel whereby when said first panel is opened away from said second panel, said triggering member will be disengaged from said biased trigger mechanism, thereby allowing said biased trigger mechanism to move to said second position.

12. The greeting card as defined in claim 11 wherein said triggering member includes a string and pin assembly secured between said first and second panels which is capable, on activation, to force confetti to be thrown outward from the second panel.

13. A greeting card as defined in claim 9, wherein said triggering mechanism comprises:

a first mating strip mounted on an outer surface of said thin film bag over said zipper-like fastener element, said first mating strip being exposed by said front side of said second panel and facing said back side of said first panel when said first panel is in said first position; and a second mating strip mounted on said back side of said first panel in a position to engage said first mating strip when said first panel is in said first position, said second mating strip pulling said first mating strip and causing said first mating strip thereby open said zipper-like fastener element when said first panel is opened away from said second panel, said second mating strip thereafter disengaging from said first mating strip as said first panel continues to open away from said first panel.

14. A greeting card as defined in claim 9, wherein said triggering mechanism comprises:

a string having a first end and a second end, said first end of said string being attached to an outer surface of said thin film bag over said zipper-like fastener element, said string extending from said front side of said second panel, said second end of said string being attached to said back side of said first panel, said string pulling and opening said zipper-like fastener element when said first panel is opened away from said second panel.

15. A greeting card as defined in claim 9, wherein said triggering mechanism comprises:

a pull tab having a first end and a second end, said first end of said pull tab being attached to an outer surface of said thin film bag over said zipper-like fastener element, said pull tab extending from said front side of said second panel, said second end of said pull tab being attached to said back side of said first panel, said pull tab pulling and opening said zipper-like fastener element when said first panel is opened away from said second panel.

16. A greeting card as defined in claim 6, wherein said first reactant comprises:

an alkaline material;

and wherein said second reactant comprises:

an acid material.

17. A greeting card as defined in claim 16, wherein said alkaline material is selected from the group consisting of:

sodium bicarbonate or sodium hydrogencarbonate; and wherein said acid material is selected from the group consisting of:

vinegar, tartaric acid, and citric acid.

18. A greeting card as defined in claim 6, wherein said first reactant comprises:

a dry material;

and wherein said second reactant comprises:

a liquid material.

19. A greeting card as defined in claim 18, wherein said dry material comprises:

powdered sodium bicarbonate and powdered citric acid in approximately a 2:1 ratio by weight of sodium bicarbonate to citric acid;

and wherein said liquid material comprises:

vinegar.

20. A greeting card as defined in claim 6, wherein said gas generating apparatus additionally comprises:

an internal septum located inside said outlet of said plastic film bag, said internal septum retaining said first and second reactant materials in said plastic film bag until said plastic film bag is ruptured by pressure therein.

21. A greeting card as defined in claim 6, wherein said gas generating apparatus additionally comprises:

a reinforcing member adhesively mounted onto a back side of said thin film bag, said reinforcing member comprising a flat segment of heavy paperboard material.

22. A greeting card as defined in claim 1, wherein said inflatable member comprises:

an inflatable balloon.

23. A greeting card as defined in claim 1, wherein said gas generating apparatus is located within said inflatable member.

24. A greeting card as defined in claim 23, wherein said inflatable member comprises:

a thin plastic film balloon having a single inlet;

a sealing member located within said plastic film balloon, said sealing member having a closed position in which said plastic film balloon is divided into two portions not in fluid communication with each other when said gas generating apparatus is inactive, said sealing member also having an open position in which said two portions of said plastic film balloon are in fluid communication with each other when said gas generating apparatus is activated;

a first reactant material located in said first portion of said plastic film balloon when said gas generating apparatus is inactive; and a second reactant material located in said second portion of said plastic film balloon when said gas generating apparatus is inactive.

25. A greeting card as defined in claim 24, wherein said sealing member comprises:

a zipper-like fastener element having a rectangular cross-sectional male zipper fastener member located on one side of said plastic film balloon which fits into a U-shaped cross-sectional female zipper fastener member located on the opposite side of said plastic film balloon;

and wherein said inflatable member additionally comprises:

a plurality of glue spots located inside said plastic film balloon on opposite sides thereof.

26. A greeting card as defined in claim 25, wherein said triggering mechanism comprises:

a first mating strip mounted on an outer surface of said balloon over said zipper-like fastener element, said first mating strip being exposed by said front side of said second panel and facing said back side of said first panel when said first panel is in said first position; and a second mating strip mounted on said back side of said first panel in a position to engage said first mating strip when said first panel is in said first position, said second mating strip pulling said first mating strip and causing said first mating strip to thereby open said zipper-like fastener element when said first panel is opened away from said second panel, said second mating strip thereafter disengaging from said first mating strip as said first panel continues to open away from said second panel.

27. A greeting card as defined in claim 1, wherein said inflatable member has greeting indicia placed thereon.

28. A greeting card as defined in claim 1, wherein said inflatable member comprises:

an inflatable party blow out.

29. A greeting card, comprising:

first and second panels which are hingedly connected together, said first panel being moveable between a first position close adjacent said second panel and a second position opened away from said second panel;

a gas generating apparatus, mounted in said second panel, for generating gas through a chemical reaction when it is activated;

a triggering mechanism operatively connected to said first panel and to said gas generating apparatus, said triggering mechanism activating said gas generating apparatus when said triggering mechanism is actuated by the movement of said first panel from its first position to its second position, said triggering mechanism initially being armed for operation with said first panel being in its first position, said triggering mechanism subsequently being actuated and in response causing said gas generating apparatus to go from said charged state to said activated state when said first panel is initially moved from its first position to its second position; and an inflatable member, said inflatable member being inflated when said gas generating apparatus generates gas.

30. A method of making a greeting card, comprising:

hingedly interconnecting a first panel to a second panel such that said first panel is foldable between a first position in which said first panel lays close adjacent said second panel and a second position in which said first panel is opened away from said second panel;

installing a gas generating apparatus in said second panel, said gas generating apparatus having a charged state in which said gas generating apparatus is inactive, said gas generating apparatus also having an activated state in which said gas generating apparatus generates gas through a chemical reaction;

operatively connecting a triggering mechanism to said first panel and to said gas generating apparatus, said triggering mechanism causing said gas generating apparatus to go from said charged state to said activated state when said triggering mechanism is actuated by the movement of said first panel from its first position to its second position;

placing an inflatable member in fluid communication with said gas generating apparatus such that said inflatable member is inflated when said gas generating apparatus generates gas; and initially arming said triggering mechanism with said first panel being in its first position so that said triggering mechanism will be actuated and in response causing said gas generating apparatus to go from said charged state to said activated state when said greeting card is initially opened by moving said first panel from its first position to its second position.

31. A greeting card, comprising:

a first panel having a front side and a back side, said first panel also having top, bottom, and side edges;

a second panel having a front side and a back side, said second panel also having top, bottom, and side edges, one side edge of said first panel being hingedly interconnected to one side edge of said second panel such that said first panel is foldable between a first position in which said first panel lays close adjacent said second panel and a second position in which said first panel is opened away from said second panel;

a gas generating apparatus carried by said second panel, said gas generating apparatus having a charged state in which said gas generating apparatus is inactive, said gas generating apparatus also having an activated state in which said gas generating apparatus generates gas through a chemical reaction, said gas generating apparatus comprising:

a thin plastic film bag having a single outlet, said inflatable member being connected to and in fluid communication with said outlet;

a sealing member located within said plastic film bag, said sealing member having a closed position in which said plastic film bag is divided into two portions not in fluid communication with each other when said gas generating apparatus is inactive, said sealing member also having an open position in which said two portions of said plastic film bag are in fluid communication with each other when said gas generating apparatus is activated;

a first reactant material located in said first portion of said plastic film bag when said gas generating apparatus is inactive;

a second reactant material located in said second portion of said plastic film bag when said gas generating apparatus is inactive; and an internal septum located inside said outlet of said plastic film bag, said internal septum retaining said first and second reactant materials in said plastic film bag until said plastic film bag is ruptured by pressure therein;

a triggering mechanism operatively connected to said gas generating apparatus to cause said gas generating apparatus to go from said charged state to said activated state when said triggering mechanism is actuated; and an inflatable member, said inflatable member being in fluid communication with said gas generating apparatus such that said inflatable member is inflated when said gas generating apparatus generates gas.

32. A greeting card as defined in claim 31, wherein said sealing member comprises:

a zipper-like fastener element having a rectangular cross-sectional male zipper fastener member located on one side of said thin film bag which fits into a U-shaped cross-sectional female zipper fastener member located on the opposite side of said thin film bag.

33. A greeting card as defined in claim 32, wherein said greeting card may be placed into an envelope, wherein said triggering mechanism comprises:

a string having a first end and a second end, said first end of said string being attached to an outer surface of said thin film bag over said zipper-like fastener element, said second end of said string being attached to said envelope, said string pulling and opening said zipper-like fastener element when said greeting card is removed from said envelope.

34. A greeting card as defined in claim 32, wherein said triggering mechanism comprises:

a pull tab attached to an outer surface of said thin film bag over said zipper-like fastener element, said pull tab extending from said front side of said second panel, said pull tab being for manual actuation, said pull tab when manually actuated pulling and opening said zipper-like fastener element.

35. A greeting card as defined in claim 32, wherein said triggering mechanism comprises:

a pull tab attached to an outer surface of said thin film bag over said zipper-like fastener element, said pull tab extending from said top edge of said second panel, said pull tab being for manual actuation, said pull tab when manually actuated pulling and opening said zipper-like fastener element.

36. A greeting card as defined in claim 32, wherein said triggering mechanism comprises:

a swing-up trigger member attached to an outer surface of said thin film bag over said zipper-like fastener element, said swing-up trigger member extending from said front side of said second panel, said swing-up trigger member being for manual actuation, said swing-up trigger member when manually actuated pulling and opening said zipper-like fastener element.

* * * * *